United States Patent [19]

Breslow

[11] Patent Number: 4,948,145

[45] Date of Patent: Aug. 14, 1990

[54] MARKET INVESTING GAME APPARATUS AND METHOD OF PLAY

[75] Inventor: Jeffrey D. Breslow, Highland Park, Ill.

[73] Assignee: Marvin Glass & Associates, Chicago, Ill.

[21] Appl. No.: 309,634

[22] Filed: Feb. 9, 1989

[51] Int. Cl.[5] ..... A63F 3/00

[52] U.S. Cl. ..... 273/256; 273/142 R

[58] Field of Search ..... 273/256, 278, 142 R

[56] References Cited

U.S. PATENT DOCUMENTS

| | | | |
|---|---|---|---|
| 3,195,896 | 7/1965 | Markham | 273/142 R |
| 3,961,795 | 6/1976 | Anspach | 273/256 |
| 4,002,342 | 1/1977 | Biggs | 273/256 |
| 4,466,515 | 8/1984 | D'Aurora et al. | 273/256 |

*Primary Examiner*—Benjamin Layno

*Attorney, Agent, or Firm*—John S. Pacocha

[57] ABSTRACT

A market investment game includes a board providing a peripheral path containing directions on play of the game, a separate, segmented track used in determining the duration of the game, and a central spinner. Both the board and the spinner are divided into different investment category areas with the board areas indicating the number of spots available for investment and the spinner areas having alternately rising and falling angling graph lines providing both buy and sell prices for each type of investment. Each player is provided with a predetermined number of markers that are allocated by the player between movers on the path, up to a certain maximum number, and units of investment. Cards provide additional play directions including penalties that are exacted when a player is "audited" by an opponent unless the player has previously opted to pay a lesser penalty.

7 Claims, 1 Drawing Sheet

MARKET INVESTING GAME APPARATUS AND METHOD OF PLAY

BACKGROUND OF THE INVENTION

1. Field of the Invention

This invention relates generally to game and more particularly to board games in which players buy and sell.

2. Background Art

There are numerous prior art games that seek to simulate, in an entertaining way, the stock market adage "buy low —sell high". For example, in U.S. Pat. No. 3,198,521 issued Aug. 3, 1965 to Kramer et al., a game simulating stock market activity is disclosed which includes a board providing a path of spaces with instructions to buy and sell certain types of stock, a single pawn for each player to move about the path of spaces, cards providing additional buy-sell instructions, and a spinner for changing the stock quotations at the beginning of each player's turn. The spinner in Kramer et al. includes a lower disk divided by radial lines and concentric circles into a plurality of spaces containing numbers and an upper disk, rotatable relative to the lower disk, that has a sector slot through which, in theory, only one number in each concentric circle is exposed to view to determine the one price at which each type of stock is both bought and sold. Nevertheless, there remains a need for a new game in which players buy and sell various investments.

SUMMARY OF THE INVENTION

The present invention is concerned with providing a market investing game including a board providing a peripheral path containing directions on play of the game, a separate, segmented track used in determining the duration of the game, and a central spinner. Both the board and the spinner are divided into different investment category areas with the board areas indicating the number of spots available for investment and the spinner areas having alternately rising and falling angling graph lines providing both buy and sell prices for each type of investment. Each player is provided with a predetermined number of markers that are allocated by the player between movers on the path, up to a certain maximum number, and units of investment. Cards provide additional play directions including penalties that are exacted when a player is "audited" by an opponent unless the player has previously opted to pay a lesser penalty.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
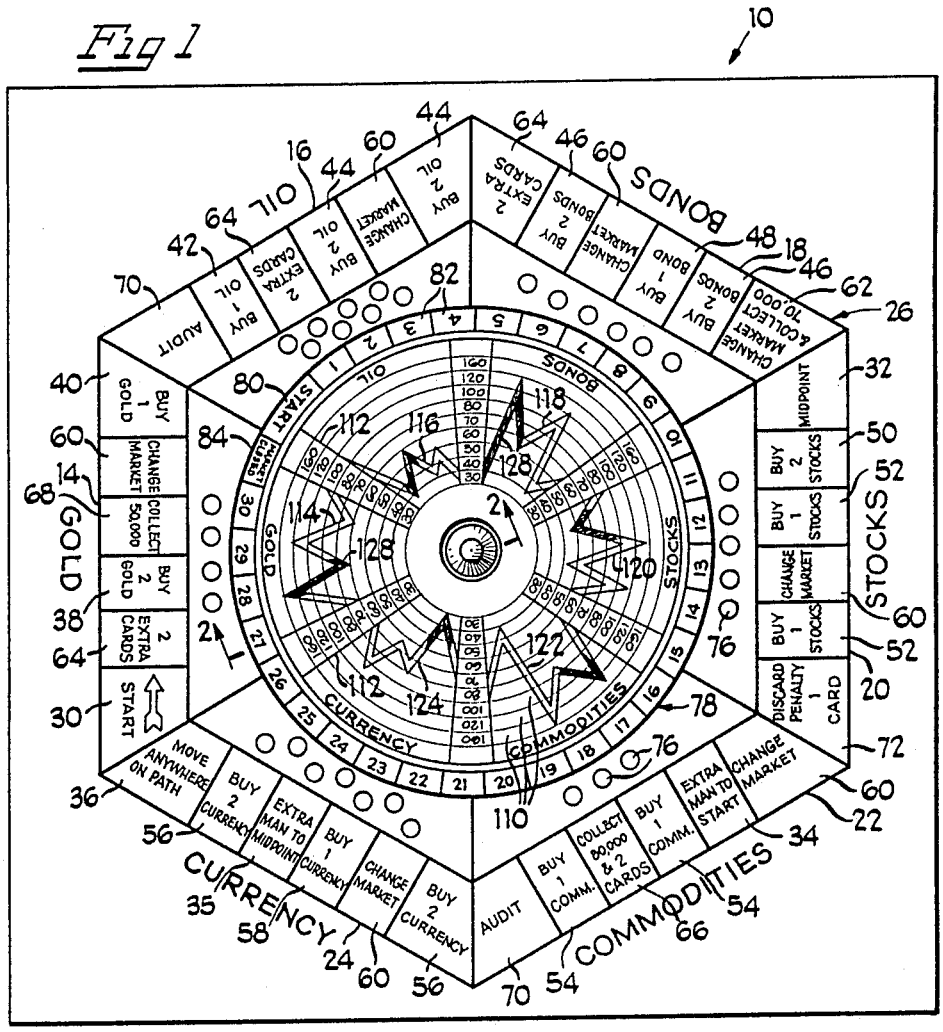
FIG. 1 is a top plan view of a game board and spinner utilized in an embodiment of the present invention.

Referring now to the drawings in which like parts are designated by like reference numerals throughout the several views, FIG. 1 shows a game board 10 used in a game for two, three or four players. Six different types or categories of investments are each represented by a separate, generally truncated triangular area on the board. Thus, there is a gold area 14, an oil area 16, a bonds area 18, a stocks area 20, a commodities area 22 and a currency area 24. A hexagonal path 26 extends along the outer side of each of the triangular areas. Each side of the hexagonal path has six spaces for a total of thirty-six spaces containing directions on play of the game.

At one end of the gold area side is a "Start" space 30 having an arrow indicating that movement along path 26 be in a clockwise direction. Diagonally opposite "Start" space 30, halfway around the path, is a "Midpoint" space 32. One space 34 on path 26 permits a player to start an extra man on "Start" space 30 while another space 35 permits a player to put one extra man on "Midpoint" space 32. There is one space 36 that permits the player to move anywhere on the path. Within each area, there are at least two spaces entitling the player to purchase one or two units of that area's investment category. Thus, gold area 14 has spaces 38 and 40 permitting the purchase of two units and one unit of gold, respectively; oil area 16 has space 42 for the purchase of one unit of oil and two spaces 44 permitting the purchase of two units of oil; bonds area 18 has two spaces 46 permitting the purchase of two units of bonds and one space 48 permitting the purchase of a single unit of bonds; stocks area 20 has one space 50 permitting the purchase of two units of stock and two spaces 52 permitting the purchase of one unit of stock; commodities area 22 has only two spaces 54 permitting the purchase of a single unit of commodities; and currency area 24 has two spaces 56 permitting the purchase of two units of currency plus one space 58 permitting the purchase of one unit of currency.

Each area has a "Change Market" space 60. In addition, there is one space 62 that entitles a player landing on it to both change the market and collect seventy thousand dollars. Three spaces 64 entitle the player to obtain two extra cards and space 66 entitles the player to obtain eighty thousand dollars in addition to two extra cards. Landing on space 68 entitles a player to collect fifty thousand dollars. Two spaces 70 permit a player to "Audit" one opposing player one card while space 72 allows a player to discard one penalty card.

Within each truncated triangular area, inboard of path 26, are a different number of spots 76 for placement of a marker. There are only three spots 76 in the highly volatile commodities market area 22; four spots in gold area 14; five spots in stocks area 20; six spots in bonds area 18; seven spots in currency area 24; and eight spots in oil area 16. Inboard of spots 76 is a segmented circular calendar track 78 having a "Start" space 80, spaces 82 consecutively numbered, from one through thirty, clockwise from "Start" space 80. In addition, track 78 has a "Market Closed" space 84 between the last numbered space and "Start" space 80.

Figure 2:
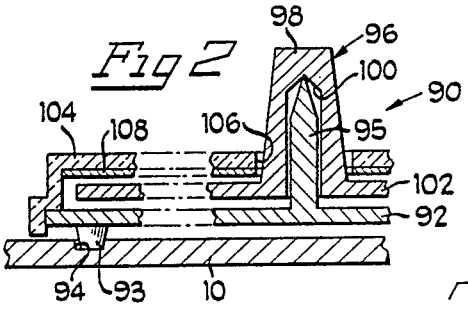
FIG. 2 is an enlarged scale, fragmentary sectional view taken generally along line 2—2 of FIG. 1.

Removably receivable in the center of board 10 is a spinner 90 which includes a base plate 92. To facilitate registration of corresponding spinner and board areas, base 92 has a number of depending feet 93 which fit into mating indentations 94 on top of board 10 as illustrated in FIG. 2. Projecting upwardly from the center of base 92 is a pointed spindle 95 which may be integrally formed as part of the base plate. Balanced atop pointed spindle 95 is a rotatable element 96 that includes a generally centrally disposed knob 98 having a bore 100 and a disk 102 around the bottom of the knob. As is illustrated in FIG. 2, bore 100 has a large enough diameter to easily fit over spindle 95 and is of a depth that maintains the bottom of disk 102 spaced above the top of base 92. It will be appreciated that the pointed tip of spindle 95 provides a low friction, minimal bearing surface about which rotatable element 96 may be spun by a user grasping knob 98 between the thumb and forefinger of one hand and giving a twist.

Secured to base 92 is an upper transparent plastic cover 104 with a central opening 106. Knob 98 projects upwardly through opening 106 with sufficient clearance to permit the spinning of disk 102 relative to both cover 104 and base 92. On the underside of transparent cover 104 is an opaque mask 108 having concentric circles forming a scale of annular bands 110 viewable through cover 104. Each band 110 is associated with an increasing numerical value forming a nonlinear scale that increases in value in a radially outward direction. The numerical values are repeated in each of six radial sectors 112. Between sectors 112 are six areas that are identified to conform with each of gold area 14, oil area 16, bonds area 18, stocks area 20, commodities area 22 and currency area 24 on board 10.

Figure 3:
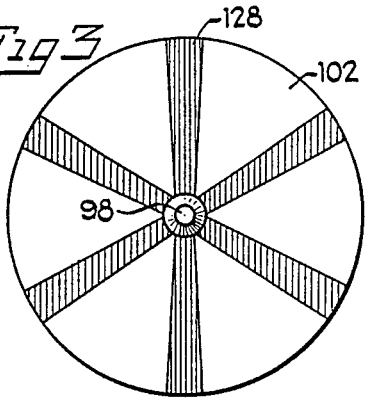
FIG. 3 is a reduced scale, top plan view of the rotatable element of the spinner.

Extending through mask 108 in each of the areas between adjacent sectors 112 are generally uniform width cutout strips 114, 116, 118, 120, 122 and 124 forming alternately rising and falling angling graph lines through which the upper face of disk 102 may be viewed. As is illustrated in FIG. 1, each designated investment area has a different cutout strip graph line 114, 116, 118, 120, 122 and 124. The upper face of disk 102 has six, equally spaced apart, sections 128. Other than sections 128, the upper face of disk 102 is the same color as the upper face of mask 108. In FIG. 3, sections 128 are lined for the color red.

When the portions of the upper face of disk 102, other than sections 128, are viewed through parts of the cutout strips in mask 108 that form the graph lines, those parts of the graph lines will be difficult to observe. However, the parts of the graph line strips through which differently colored sections 128 appear will be readily discernable. Hence, when rotatable element 96 is spun and comes to rest, the new position of sections 128 relative to the cutout graph lines and the opaque sectors containing the numerical indicators, will, by chance, change from the position before element 96 was spun. Each of cutout strip graph lines 114, 116, 118, 120, 122 and 124 simultaneously indicate, within the predefined range of the particular graph line, both the buy and sell prices by the respective low and high point appearances of sections 128 in the cutout graph line strips.

Radial sectors 112 containing the numerical indicators do not have any cutout strip and hence remain completely opaque. Because of the spacing and width of radial sectors 112 relative to strips 128, it is possible that one or more of strips 128 may be obscured by sectors 112 when element 98 comes to rest and hence not be visible through any of the cutout graph line strips. Conveniently, sections 128 are offset slightly from sectors 112 to preclude all of sections 128 from being obscured by sectors 112.

Figure 4:
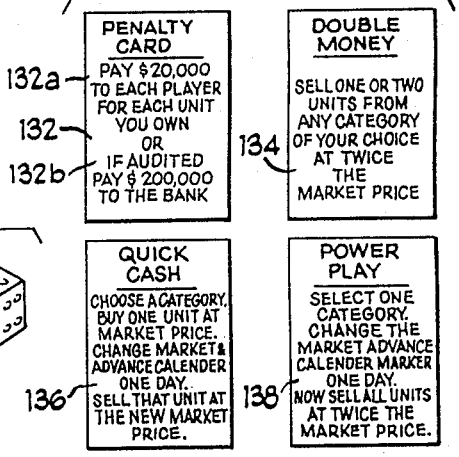
FIG. 4 is an enlarged scale, top plan view of the face of exemplary cards used in the embodiment.
Figure 6:
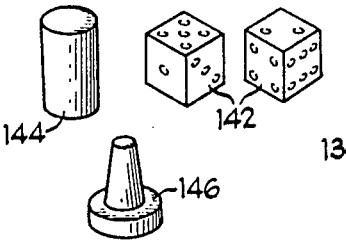
FIG. 6 is an enlarged scale, perspective view of dice, a token and a representative marker used in the embodiment.
Figure 5:
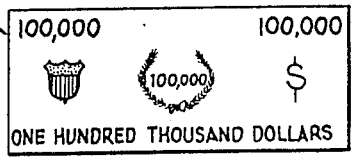
FIG. 5 is an enlarged scale, top plan view of an exemplary piece of simulated currency used in the embodiment.

Play directions, in addition to those provided by the spaces in path 26, are contained on faces of a deck of cards. All of the card backs (not shown) have the same design so that one card cannot be discerned from another when the cards are held in the player's hand or placed face down in a draw pile. Faces of exemplary cards are illustrated in FIG. 4.

Included in the deck are a number of "Penalty" cards 132. Once a player is dealt or picks a "Penalty" card, space 72 provides the only opportunity to dispose of the "Penalty" card without having to pay a penalty. However, each "Penalty" card presents a choice between two evils. A player holding a "Penalty" card may elect at any time during the game to pay an upper penalty such as penalty 132*a*. However, once audited by an opposing player, the player holding the "Penalty" card no longer has any choice but must then pay a bottom penalty such as penalty 132*b*. The upper penalty is either less drastic on its face or may, because of other circumstances, be easier to accept than the risk of having to pay the bottom penalty if audited. For example, at the time that a player only owns a single investment unit, it would be advantageous to pay only twenty thousand dollars under penalty 132*a* rather than risk being later audited and having to pay ten times as much under penalty 132*b*.

Some of the card directions are the same as those in spaces around path 26. Thus, there are cards directing players to move anywhere on the path like space 26, put extra pieces on "Start" or "Midpoint" like spaces 34 and 35, respectively, "Audit" like spaces 70, and "Change Market" like spaces 60. A few of the cards may present slight variations of the path space directions. For example, while the general rule is that whenever the market is changed by operation of spinner 90, calendar 78 is advanced one of the consecutively numbered spaces to move closer to the market being closed, a variation of that direction may be contained on a "Change Market" card directing the calendar to be advanced two spaces.

Other cards in the deck provide players with an opportunity to make more money than they could in the normal course of buying and selling investments. A "Double Money" card 134 allows a player to sell one or two units from any investment category of the player's choice at twice the market price then showing on spinner 90. Playing a "Quick Cash" card 136 allows a player to buy one unit of an investment category chosen by the player at the then existing market price, change the market and then sell the unit at the new market price. It is possible that the new market price may be lower than the previous market price. Accordingly, it would not be good strategy for a player to play "Quick Cash" card 136 unless the player were able to select an investment category in which the buy price was at the lowest, or almost the lowest, point on the appropriate graph line. There is also a "Power Play" card 138 that permits a player to select an investment category, change the market, and sell all units of that investment category at twice the market price.

Whenever a player operates spinner 90 and no part of a red section 128 is visible in the cutout graph line for one or more investment categories, "Black Monday" is deemed to have occurred. The player that has caused "Black Monday" to occur then loses all of the investments that the player had and must remove all of that player's markers from spots 76. That player then again operates spinner 90 to reset the market and advances the calendar one space ending a rather disastrous turn. A "Black Monday" card (not shown) is also included in the deck of cards. However, the player holding the "Black Monday" card may play it on an opponent forcing the opponent to lose all of the investments held by the opponent in an investment category chosen by the player holding the "Black Monday" card.

A supply of simulated currency 140 is included in the game as are a pair of dice 142, a number of markers 144 and a single calendar token 146. There is a total of forty markers 144 divided into four groups of ten markers each. Each group of ten is distinguished from every other group by color, graphic indicia and the like.

To begin play of the game, spinner 90 is positioned in the center of board 10 with the respective investment category areas of each in register. An amount of currency, conveniently five hundred thousand dollars, is distributed to each player with the remainder forming a "bank". Also allocated to each player is a group of ten identical markers 144. Each player places one marker on "Start" space 30 and reserves the other nine markers off of the board. During the course of playing the game, markers 144 will be used both as path space markers and as investment markers. The deck of cards is shuffled and each player is dealt two cards face down with the remaining cards being placed face down in a draw pile off of the game board. Any one player opens the market by operating spinner 90. If no part of a red section 128 is visible in any one of the areas, the player operates the spinner again until there is a red indication in each of the investment category graph lines. Calendar token 146 is placed on "Start" space 80 of circular calendar 78. Players then roll dice 142 to determine the starting player by the highest number rolled. The order of play then proceeds clockwise from the starting player.

At any time during the course of playing the game, the player may, during a turn, first play one of the cards and/or then sell an investment already owned by the player. While it is the player's choice whether to do either, both or none of these two steps, they must be done in the order specified, if at all. After playing a card and/or selling an owned investment, or electing to do neither, the player rolls the dice and moves any one marker on path 76 all of the number of spaces indicated by the count on the top faces of the dice. The number of available moves may not be split with other markers. During the course of play, a player may elect to introduce additional markers 144, up to a maximum of three, onto path 26 whenever the player lands on either of spaces 34 or 35 or the player plays a card containing similar directions. Once a marker is put into play on path 26, it may not be removed from the path for use as an investment marker.

A player may sell any or all of the units of a investment category whenever, at the beginning of a turn, the player has a marker on any of the six spaces within the same investment category area. Investments may also be sold upon play of an appropriate card in accordance with the directions on the face of that card, as for example cards 134, 136 and 138. Generally, sales of an investment are made at the highest price indicated by section 128 in the appropriate cutout graph line strip on spinner 90 times the number of units being sold. However, if the selling player has cornered the market in the investment category being sold and occupies all spots 76 in that area, the sales will be made at triple the market selling price indicated on spinner 90. Proceeds from the sale are provided by the bank. The player's marker 144 is then removed from spot 76 and returned to the players off-board reserve of markers.

If a player lands on an "Audit" space 70 on the game board path, or plays an "Audit" card, the player picks an opponent to "Audit." The opponent must then show all of the opponent's cards briefly to the auditing player who checks for "Penalty" cards and selects a "Penalty" card from which the opponent must pay the bottom penalty.

Three conditions must be fulfilled to enable the player to purchase an investment. First, the player must land on one of the spaces within the investment category area authorizing the purchase of one or two units or play an appropriate card such as "Quick Cash" card 136. Secondly, one spot 76 must be open in the investment category for each unit the player is authorized to and wishes to buy. Finally, the player must have a marker available in reserve for each unit of the investment that the player is authorized to purchase and for which spots are available. Purchases of an investment are made at the lowest price indicated by section 128 in the appropriate cutout graph line strip on spinner 90 times the number of units being purchased. The purchase price is paid to the bank. After purchasing an investment, the player's marker 144 remains on appropriate spot 76 until that unit of the investment is sold.

Market prices are changed each time a player lands on a "Change Market" space 60 or 62 or whenever the player plays an appropriate card such as 136 or 138. Every time spinner 90 is operated to change the market price, token 146 is advanced one space on circular calendar 78 except in those instances where a card may direct that token 146 be advanced two spaces. Play of the game continues until token 146 is advanced to the "Market Closed" space 84 at which time the winner is determined by the player having the most currency. Unsold investments are not counted in determining the winner. Prior to counting the currency held by each player to determine the winner, each player must pay the bottom, "Audit", amount indicated on each "Penalty" card still being held by the player when the market closes.

While a particular embodiment of the present invention has been shown and described with some variations, other variations and modifications will occur to those skilled in the art. It is intended in the appended claims to cover all such variations and modifications as fall within the true spirit and scope of the present invention.

What is claimed as new and desired to be secured by Letters Patent is:

1. A game for a plurality of players comprising in combination:

a board;

a pathway on the board;

the pathway including spaces containing directions on play of the game including directions permitting a player to make purchases;

a spinner for determining by chance, the price, within a certain predefined range, at which purchases may be made;

the spinner simultaneously indicating a price, within a certain predefined range, different from the purchase price, at which sales may be made;

the spinner including a generally opaque upper member having a transparent strip that extends circumferentially and alternately angles away from the center of the member and back toward the center in sections of different lengths;

a spinner also including a lower member disposed beneath the upper member and having an upwardly directed face;

the upwardly directed face generally being of the same color as the generally opaque upper member but having a number of sections that are distinguished by color from the generally opaque member; and one of the members being rotatable relative to the other.

2. A game for a plurality of players comprising in combination:

a board;

a pathway on the board;

the pathway including spaces containing directions on play of the game including directions permitting a player to make purchases;

a spinner for determining by chance, the price, within a certain predefined range, at which purchases may be made;

the spinner also simultaneously indicating a price, within a certain predefined range, different from the purchase price, at which sales may be made; and means separate from the pathway for marking each occurrence of an event to determine the duration of play of the game.

3. A method of playing a game comprising the steps of:

providing a board having areas representing different categories of investments, a peripheral path divided into spaces containing play directions, and a number of spots in each area indicating the number of available units in each investment category;

allocating a predetermined number of distinguished markers to each player for use on either the path spaces or the spots;

permitting each player to use more than one of the markers, up to a predetermined maximum number of the markers, on the path; and requiring that a player have a marker available for placement on an open spot in the investment category in which the player wishes to make a purchase and further requiring the player to leave the marker on the spot until the purchased unit is sold.

4. The method of claim 3 including the step of:

permitting the player to reuse a marker after it has been removed for an investment category spot; and prohibiting the player from moving a marker from the path to any one of the investment category spots.

5. The method of claim 3 including the step of permitting the player to sell units of an investment category that the player owns at any time the player has a marker in a portion of the path that is in the area of the investment category that the player wishes to sell.

6. A method of playing a game comprising the steps of:

providing a board having areas representing different categories of investments, a peripheral path divided into spaces containing play directions, and a number of spots in each area indicating the number of available units in each investment category;

allocating a predetermined number of distinguished markers to each player;

permitting each player to use up to a predetermined maximum number of the markers on the path;

requiring that a player have a marker available for placement on an open spot in the investment category in which the player wishes to make a purchase and further requiring the player to leave the marker on the spot until the purchased unit is sold;

supplying cards containing further play directions including alternative penalties; and allowing a player to elect to pay one of the alternative penalties before the occurrence of an event forces the player to pay the other alternative penalty.

7. A method of playing a game comprising the steps of:

providing a board having areas representing different categories of investments, a peripheral path divided into spaces containing play directions, and a number of spots in each area indicating the number of available units in each investment category;

allocating a predetermined number of distinguished markers to each player;

permitting each player to use up to a predetermined maximum number of the markers on the path;

requiring that a player have a marker available for placement on an open spot in the investment category in which the player wishes to make a purchase and further requiring the player to leave the marker on the spot until the purchased unit is sold;

marking each occurrence of a particular event during the course of play of the game; and determining the duration of the game upon marking a predetermined number of the occurrences.

* * * * *